US006746344B1

(12) United States Patent
Long

(10) Patent No.: US 6,746,344 B1
(45) Date of Patent: Jun. 8, 2004

(54) PUTTER HEAD WITH CAVITIES

(75) Inventor: D. Clayton Long, Carlsbad, CA (US)

(73) Assignee: Plus 2 International, Inc., Carlsbad, CA (US)

( * ) Notice: Subject to any disclaimer, the term of this patent is extended or adjusted under 35 U.S.C. 154(b) by 74 days.

(21) Appl. No.: 10/106,417

(22) Filed: Mar. 25, 2002

Related U.S. Application Data

(63) Continuation-in-part of application No. 09/336,326, filed on Jun. 18, 1999, now abandoned.

(51) Int. Cl.[7] ..... A63B 53/04
(52) U.S. Cl. ..... 473/346; 473/332
(58) Field of Search ..... 473/324, 329, 473/332, 334, 335, 336, 340, 341, 342, 345, 346, 350, 251

(56) References Cited

U.S. PATENT DOCUMENTS

| | | | | |
|---|---|---|---|---|
| 4,693,478 A | | 9/1987 | Long | |
| 4,824,110 A | | 4/1989 | Kobayashi | |
| 4,869,507 A | * | 9/1989 | Sahm | 473/337 |
| 5,290,036 A | | 3/1994 | Fenton et al. | |
| 5,431,396 A | * | 7/1995 | Shieh | 473/329 |
| 5,470,068 A | * | 11/1995 | Schmidt et al. | 473/311 |
| 5,489,097 A | | 2/1996 | Simmons | |
| 5,690,562 A | | 11/1997 | Sturm | |
| 5,769,737 A | | 6/1998 | Holladay et al. | |
| 5,803,825 A | | 9/1998 | Hamilton | |
| 5,944,619 A | | 8/1999 | Cameron | |
| 6,001,030 A | | 12/1999 | Delaney | |
| 6,080,069 A | | 6/2000 | Long | |
| 6,083,117 A | | 7/2000 | Hsu | |
| 6,159,109 A | * | 12/2000 | Langslet | 473/332 |
| 6,210,290 B1 | * | 4/2001 | Erickson et al. | 473/345 |
| 6,231,458 B1 | | 5/2001 | Cameron et al. | |
| 6,273,831 B1 | * | 8/2001 | Dewanjee | 473/324 |
| 6,273,832 B1 | * | 8/2001 | Helmstetter et al. | 473/324 |
| 6,336,869 B1 | * | 1/2002 | Hettinger et al. | 473/324 |
| 6,386,991 B1 | * | 5/2002 | Reyes et al. | 473/346 |

* cited by examiner

*Primary Examiner*—Raleigh W. Chiu
*Assistant Examiner*—Tom Duong
(74) *Attorney, Agent, or Firm*—Smith, Gambrell & Russell, LLP

(57) ABSTRACT

The present invention discloses a golf putter head with vertical and horizontal cavities.

29 Claims, 8 Drawing Sheets

SECTION I-I

PUTTER HEAD WITH CAVITIES

CROSS-REFERENCE TO RELATED APPLICATIONS

This application is a continuation-in-part of patent application Ser. No. 09/336,326 filed Jun. 18, 1999 now abandoned, which is relied on and incorporated by reference.

BACKGROUND OF THE INVENTION

The invention relates generally to golf putters and more particularly to golf putter heads having a cavity filled with a lightweight polymer. Such a construction for a golf putter head can provide an enlarged putter head, a high rotational moment of inertia across the striking surface of the putter, a thicker, reinforcing rearwardly extending flange, improved dampening of vibration and a deadened sound upon impact with the ball, all of which combine to produce a more forgiving putter that is easier to align and has a more solid feel when striking the ball.

In order to putt a golf ball accurately, it is first necessary to align the putt properly, keeping the striking surface of the putter perpendicular to the line of the putt. It is important to keep the striking surface perpendicular to the putting line during the impact portion of the stroke, and to strike the ball with the optimum portion of the striking surface, known as the sweet spot, for transferring energy to the ball. The sweet spot is generally located around the center of mass of the putter head. Accuracy and effectiveness of the putt depends on the amount of energy transferred from the putter head to the ball and minimizing the amount of energy lost due to vibration and twisting of the head during impact.

As the striking surface meets the ball, there is a tendency for the putter head to twist if the ball is struck away from the center of mass of the putter head. This can severely decrease the accuracy of the putt. In order to reduce the effect of off-center hits, numerous putters have been designed with weights in the heel and toe of both normal sized putters and oversized putters to increase the putter head's rotational moment of inertia.

It is also desirable to minimize the loss of energy due to vibrations upon impact or to dampen these vibrations. This produces a more "solid feel" when the striking surface meets the ball. Some prior art putters have attempted to reduce the vibration created when striking a ball by inserting a polymer in a shallow cavity along the striking surface of the blade. This, however, does not significantly displace enough heavy material to enable an oversized putter head to be made properly, nor does it significantly change the inertia properties of the putter head. The prior art methods also make it difficult to construct an oversized putter head with thick enough sections to reduce vibrations, since the larger the putter head, the thinner the remaining metal structure must be. Exposing the polymer on the striking surface may alter the sound made when striking the ball, but also provides a surface that is more prone to wear unevenly, producing a concave striking surface which is detrimental to accurate putting. An example of this type of construction is the Odyssey putter made by Callaway Golf.

Others have tried to minimize vibrations by providing a solid flange behind the blade of the putter head. One such putter head is described in Long U.S. Pat. No. 4,693,478. These methods are limited to either standard sized putter heads, or putter heads made from combinations of aluminum and other heavier materials. The aluminum used in these constructions is soft and not wear resistant, nor durable in the neck and hosel portions of the putter head.

Still other prior art attempts at constructing oversized putter heads have resorted to large hollowed out portions of the heads making them vibrate upon impact with the golf ball. These prior methods have also produced thin faces and rear flanges due to their construction designs. Examples of such constructions are U.S. Pat. No. 4,655,459, the Macgregor "Response LT" putters, and the Nicklaus Golf Equipment Company "The Bear IQ" putter.

In order to execute an accurate putting stroke, it is important that the ball is struck near the center of mass of the putter head. This portion of the striking surface is known as the "sweet spot". Striking the ball near the sweet spot assures maximum energy transfer from the putter head to the ball. It is therefore desirable to have a putter with a larger sweet spot. It is also desirable to have a putter head constructed of a strong durable material that resists bending, denting and fracture during use, resists corrosion, is large in size providing easy alignment, and high in moment of inertia about its center of gravity, and dampers vibration caused by impacting a golf ball.

SUMMARY OF THE INVENTION

Generally described, the present invention is a golf putter head with a hollow vertical interior cavity between the striking face and blade rear surface of the putter head and a horizontal cavity between the sole surface and upper portions of the putter head behind the blade. In an embodiment of the invention, the vertical and horizontal cavities are filled with a lightweight polymer. By distributing a greater portion of the putter head mass to the toe and heel section of the putter head, the moment of inertia along the striking surface of the putter is increased.

The present invention further provides a putter head with an internal "L-shaped" cavity and incorporates a suspended insert in the striking face where the insert is greater than 50% of the striking face area. In an embodiment of the present invention, a horizontal portion of the "L-shaped" cavity extends beneath a sighting recess toward the striking face. The vertical portion of the "L-shaped" cavity extends between the striking face and sighting recess. In embodiments of the invention, the horizontal cavity may include a plurality of horizontal cavities. In further embodiments of the invention the "L-shaped" cavity is filled with a lightweight polymer. In another embodiment of the invention, weights are suspended in the polymer-filled cavities to suppress vibration as well as to provide preferred weighting and mass distribution.

The present invention also provides a golf putter head with an internal cavity behind the striking face, the cavity enclosed on at least one side by an unperforated surface of the rear blade, and the internal cavity having a cross-sectional area of greater than fifty-percent (50%) of the area of the striking face. In an embodiment of the invention, the cavity is filled with a lightweight polymer.

It is therefore an object of the present invention to provide a golf putter head that is easy to align to achieve an accurate putt.

It is a further object of the present invention to provide an oversized putting head constructed of standard materials used in small sized putter heads.

It is a further object of the present invention to provide a golf putter head with a high moment of inertia through the center of gravity of the putter, to resist twisting upon striking the ball.

it is a further object of the present invention to increase the size of the sweet spot on the striking surface of the putter.

It is still a further object of the present invention to minimize energy loss due to vibration while putting.

It is yet a further object of the present invention to provide a putter that makes a deadened, softer sound upon impact with a golf ball.

And further still it is an object of the present invention to provide a putter head that is durable, resistant to bending, dent resistant, and corrosion resistant.

The foregoing objects are accomplished by a putter in which the putter head has a thin metallic outside shell with an internal cavity filled with a lightweight polymer.

In further embodiments of the invention, the striking face includes an insert that is suspended from the putter head and secured in place by the polymer in the cavity behind the striking face. In an embodiment of the invention, an O-ring may be used to position the insert on an insert groove extension.

Other objects and advantages of the invention will become apparent upon reading the following detailed description and upon reference to the drawings.

DETAILED DESCRIPTION

Figure 1:
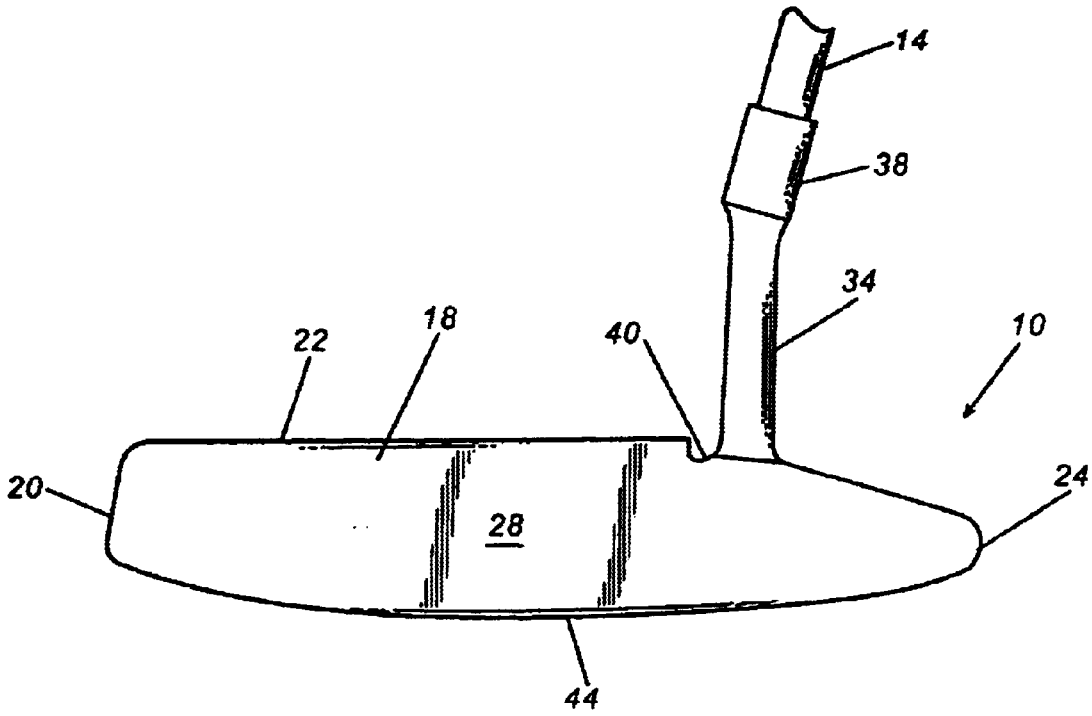
FIG. 1 is a front elevation view of the putter head of the present invention.
Figure 3:
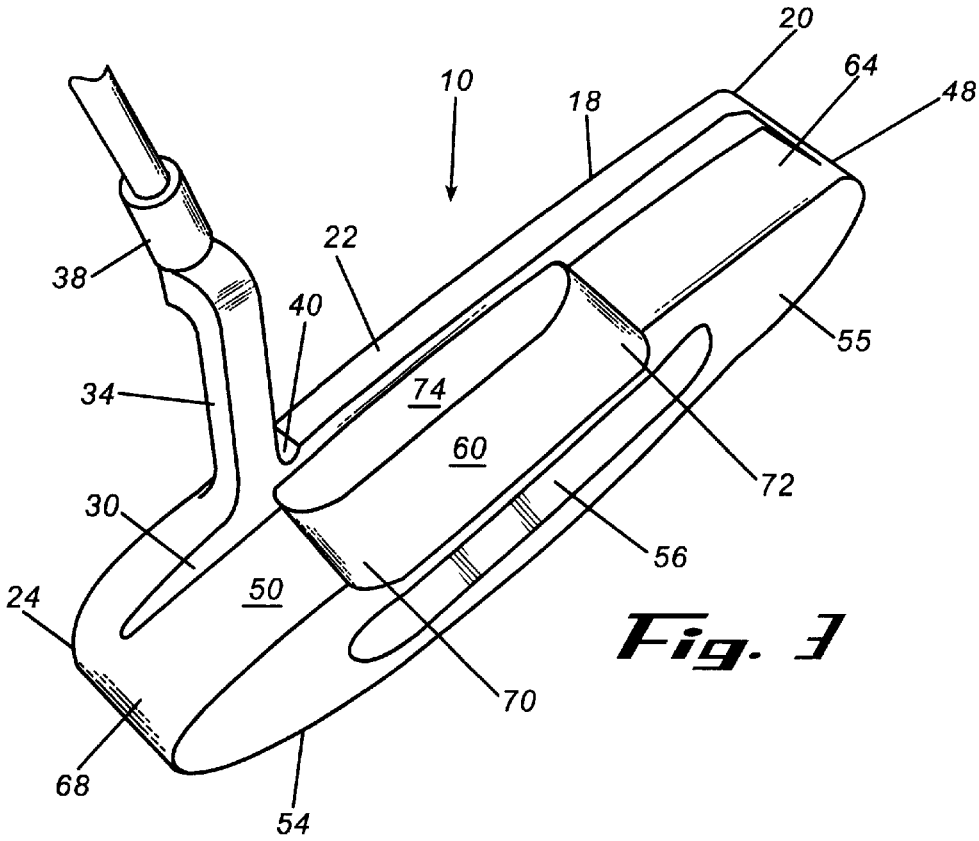
FIG. 3 is a perspective view of the putter head of the present invention.

Referring now to the drawings, in which like numerals refer to like parts throughout the several views, FIG. 1 shows a golf putter head embodying the present invention. As shown in FIG. 1, the head 10 is normally mounted on a shaft 14 for use in putting. The head 10 consists of a thin, elongated blade 18 having a toe end 20, a heel end 24, a striking surface 28, a top surface 22 adjacent to the striking face and a rear surface 30 (FIG. 3).

A hosel 34 is attached to the top surface 22 of the blade 18. The shaft 14 is affixed to a cylindrical end portion 38 of the hosel. A small notch 40 in the top surface 22 of the blade 18 is positioned adjacent to the hosel 34.

Figure 2:
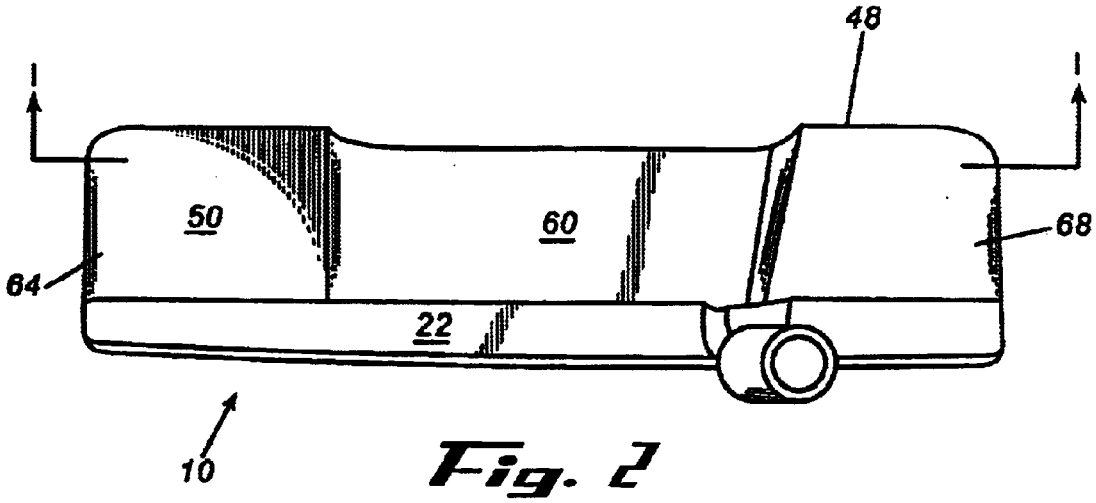
FIG. 2 is a top plan view of the putter head of the present invention.

The blade 18 consists of a blade sole 44 to which a flange 48 (FIGS. 2 and 3) is attached. The flange 48 has a top surface 50 which extends rearwardly from the rear surface 30 of the blade 18. The top surface 50 of the flange 48 has a length equal to the length of the blade 18.

Figure 15:
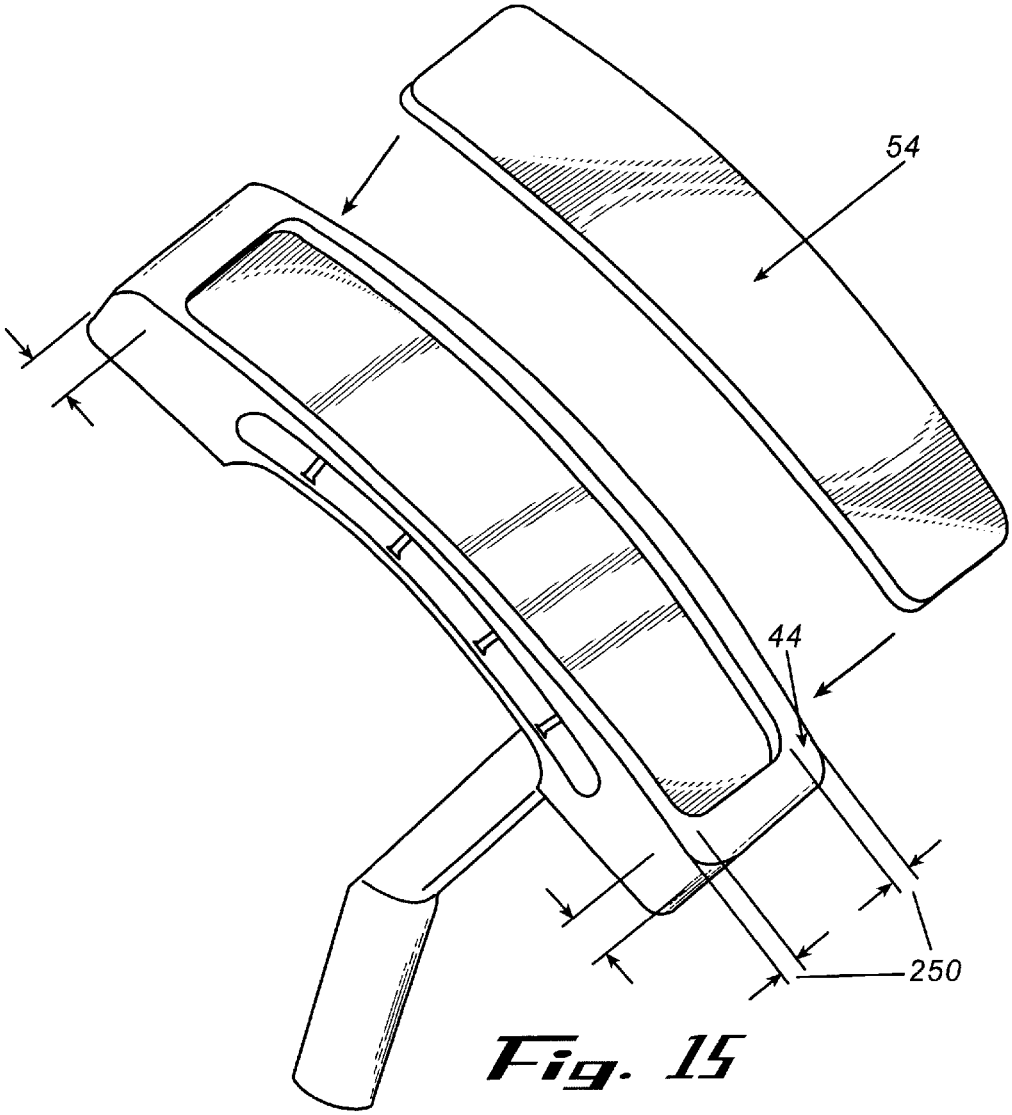
FIG. 15 is a bottom perspective view of the sole of a putter head in an embodiment of the present invention.

Referring to FIG. 15, a soleplate 54 is attached to the blade sole 44 and the flange 48 forming a hollow cavity 56 (FIG. 3) inside the putter head 10. The soleplate 54 is less than the width of the putter defined by the leading edge and trailing edge, and less than the length of the putter head defined by the toe and heel. The gaps 250 formed between the soleplate edges and the edges of the putter sole 44 allow for room to weld the soleplate 54 to the head body. The soleplate 54 is located in the sole opening and prevented from falling into cavity 56 by means of a step or tabs which are well known in the art and used for such purposes. The hollow cavity 56 has a length substantially equal to the length of the flange 48, and may extend into the blade 18 under the top surface 22 and between the striking surface 28 and the rear surface 30. The hollow cavity 56 may be filled with a lightweight polymer such as urethane or any other polymer which has a hardness and resiliency less than the metal used to make the blade, flange and sole plate.

Figure 4:
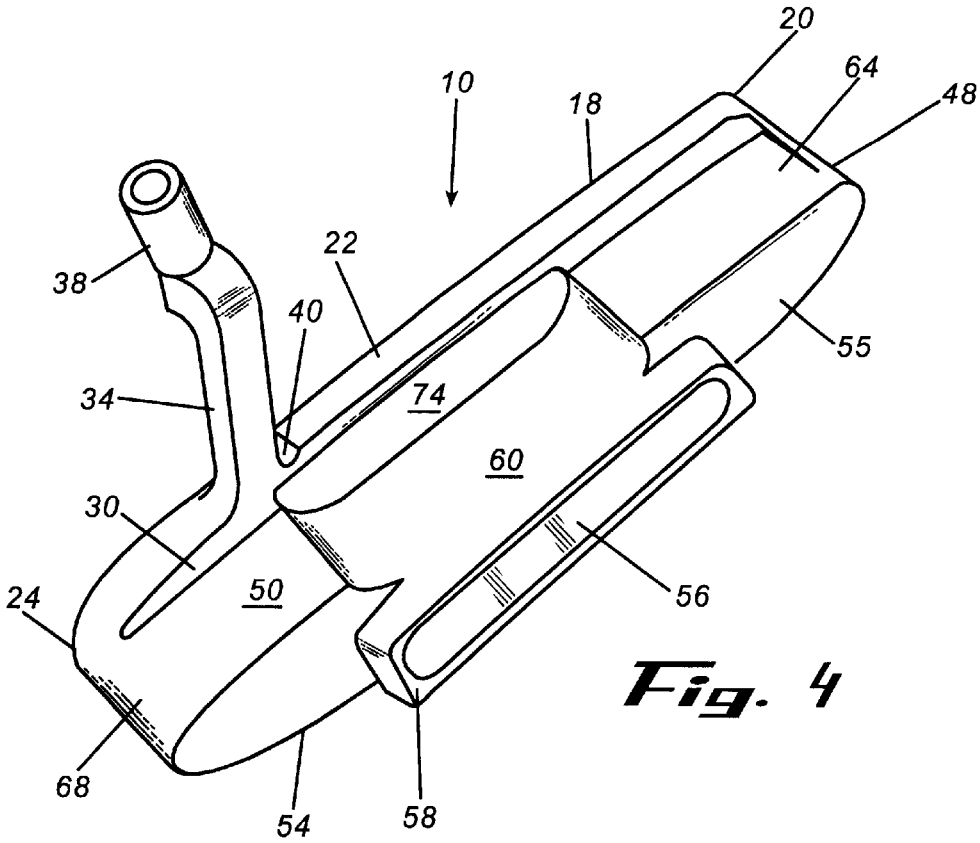
FIG. 4 is a perspective view of the putter head of the present invention prior to machining of the funnel provided for filling the hollow cavity with liquid polymer.

Referring to FIG. 4, in order to properly fill the cavity 56 with the polymer, a funnel 58 is provided on a rear portion 55 of the flange 48. The head 10 is placed on its striking surface 28 so that a liquid polymer may be poured into the cavity 56 through the funnel 58. Air bubbles in the liquid polymer rise into the funnel 58 from the cavity 56. After the polymer has hardened, the funnel 58 is machined off so that the rear portion 55 of the flange 48 is substantially flat. The hardened polymer residing in the cavity 56 is visible in the rear of the flange.

The rearwardly extending flange 48 reinforces the blade 18 of the putter and reduces vibrations created when striking the ball. The use of the polymer inside the hollow cavity 56 further dampens the vibrations created upon impact. This improves energy, transfer between the putter head and ball and provides a more solid feel when the golf ball is struck. Additionally, by filling the hollow cavity 56 with a lightweight polymer, the sound upon impact is deadened. This prevents any annoying ringing sound when striking the ball. The reinforcement of the polymer-filled rearwardly extending flange 48 and the lightweight polymer-filled blade allows the damping of impact vibrations even though the striking face is thin walled. The resulting thin outer metal shell construction with interior spaces filled with a lighter weight polymer allows the putter head to be oversized without being too heavy.

The flange 48 has a center section forming a recess 60 which is relatively thinner than its toe section 64 and its heel section 68. The recess 60 has two curved side surfaces 70 and 72.

Figure 5:
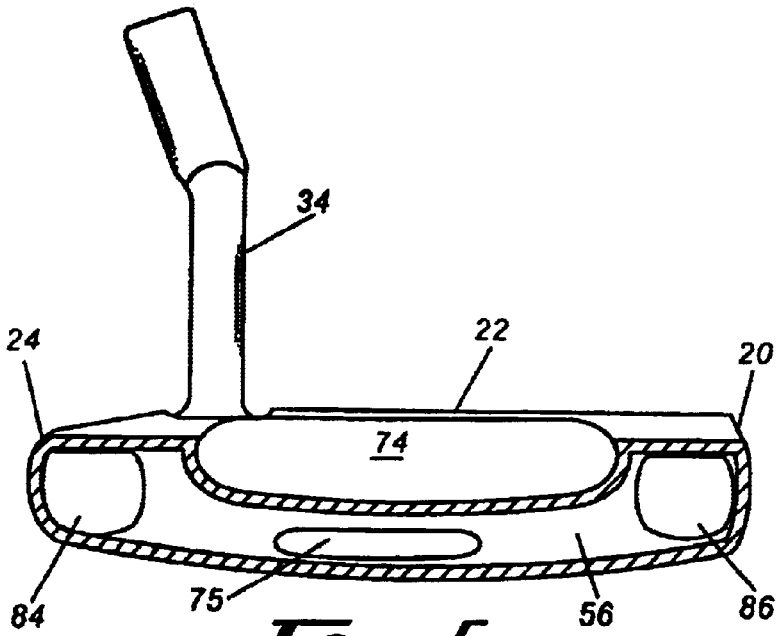
FIG. 5 is a cross sectional rear view of the putter head of the present invention along the line I—I in FIG. 2.

As shown in FIGS. 3 and 5, separate weights 84, 86 of a material higher in density than the polymer material may be placed into the heel section 68 and the toe section 64 of the flange 48 before the sole plate 54 is attached to the blade sole 44. These weights 84, 86 could also be placed in the toe 20 and heel 24 of the blade if so desired. After filling the remaining internal spaces with a lightweight polymer, the loose additional weights 84, 86 become fixed and provide further improved inertial characteristics. This mass distribution also increases the optimum portion of the striking surface, known as the sweet spot, for transferring energy to the golf ball. In another embodiment of the present invention the toe section 64 and the heel section 68 of the flange 48 may be solid or partially solid, rather than hollow in order to distribute mass of the putter head. This reduces the size of the hollow cavity 56. By distributing the mass to the two thicker sections 64 and 68 of the flange 48, the moment of inertia is maximized along the striking surface 28 of the blade 18 minimizing the tendency for the putter head to twist upon impact if the point of impact is slightly displaced from the center of mass of the putter head.

The rear surface 30 (FIG. 3) of blade 18 has a shallow recess 74. The shallow recess 74 is adjacent to the recess 60 in the center of the flange. The recess 60 is used to align the ball with the optimal portion of striking surface 28 prior to putting.

The solid portions of the putter head 10 may be formed from various metals such as brass, bronze, stainless steel or titanium. The advantages of using these materials are that they are relatively easy to cast or machine in thin sections, as would be required in the present invention, readily welded, strong, durable, and very corrosion resistant. The solid portions of the putter head may also be formed from different steels and plated or otherwise treated to provide corrosion resistance.

The polymer located inside cavity 56 may include urethane or any other lightweight polymer which has a hardness and resiliency less than the metal used to make the solid portions of the putter. The hardness of the material used effects the sound the putter makes when striking the ball by providing various degrees of damping for the vibrating outside metal putter head 10. The density of the polymer may also be varied to effect the overall weight of the putter head 10. In a very large putter head design the internal cavity 56 may be large and require a less dense polymer than in a smaller head design. Generally, most putter heads are made in a narrow range of finished weights regardless of size. In some cases, however, it is advantageous to vary the finished weights of putter heads made at different shaft lengths to achieve the proper swing weight. Shorter shaft length putters would require heavier heads and thus a more dense polymer. Since changing the weight of a casting or machine part is time consuming and costly due to mold and programming alterations, the present invention offers a fast flexible method to vary the weight of putter heads, by using polymers of differing densities, as required. By filling hollow cavity 56 with a lightweight polymer and placing individual or a plurality of weights in toe section 64 and heel section 68, the mass of the putter head 10 can also be adjusted and is distributed towards the heel and toe. This increases the sweet spot by providing a lightweight material, such as a polymer, in the center portion of the putter head behind the central section of the striking face and central portion of the flange, and ensuring that the heavier metal sections are located towards the heel and toe.

With continuing reference to FIG. 5, weights 84 and 86 may be dipped in polymer, such as the polymer used to fill cavity 56, in order to prevent the undesired effects of metal contact between a weight and the putter head. Accordingly, prior dipping of the weight permits the weight to be incorporated in the surrounding polymer with a polymer to polymer contact within the cavity 56.

In another embodiment of the present invention, a damping material 75 may be inserted into the hollow cavity 56 and suspended in the polymer as shown in FIG. 5. The damping material 75 should be of a density greater than the density of the polymer used to fill the cavity. The inserted damping material 75 will further dampen vibrations by moving inside the putter head when a ball is struck.

Figure 8:
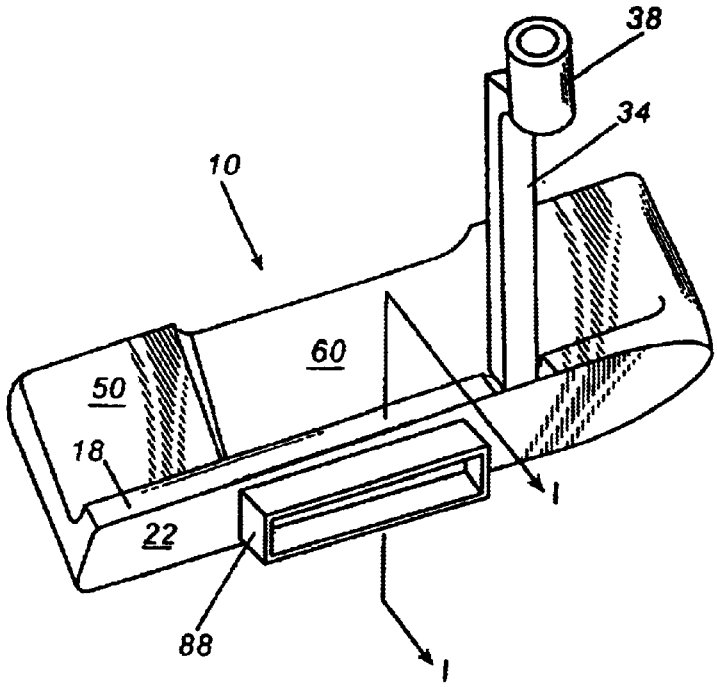
FIG. 8 is a perspective front view of another embodiment of the present invention.
Figure 8A:
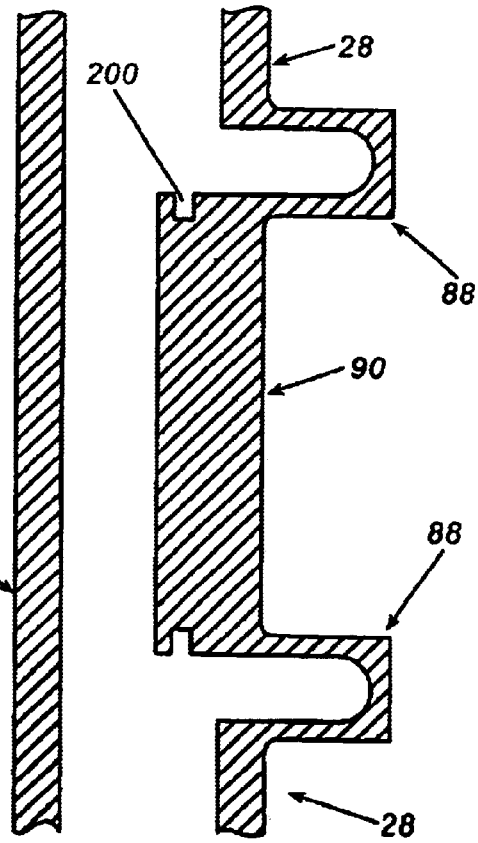
FIG. 8A is a cross-sectional side view along line I—I of FIG. 8.

In another embodiment of the present invention, the putter head 10 may be molded to include a rectangular ridge 88 in the shape of a box, or any desired insert shape, extending from the striking surface 28, as shown in FIGS. 8 and 8A. The walls of the rectangular ridge 88 extend perpendicularly from the striking surface 28. The putter head 10 is molded such that the rectangular ridge 88 surrounds and is connected to a solid insert 90. The exterior surface of the solid insert 90 is flush with the striking surface 28.

Figure 7:
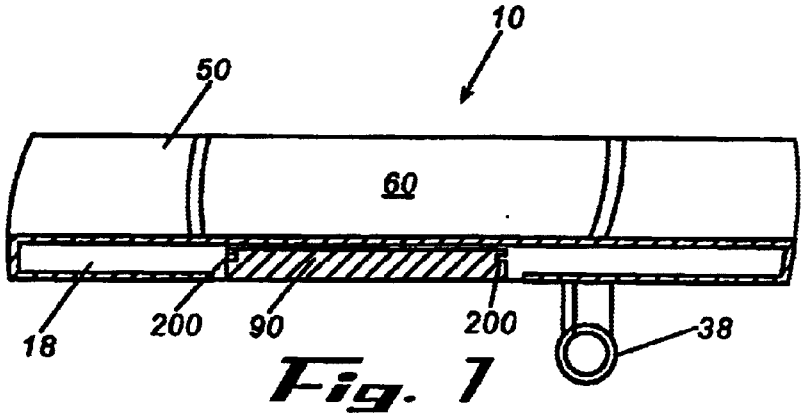
FIG. 7 is a cross sectional top view of the putter head of the present invention along the line II—II in FIG. 6.

As shown in FIGS. 7, 8, and 8A the insert 90 projects into the cavity 56 of the putter head 10, within the blade 18 and has a means either by external grooves 200 or holes, by which the polymer will adhere and fix the position of the insert. The insert 90 is a rectangular body with an exterior surface surrounded by the rectangular ridge 88. The insert is made of the same material as the putter head 10. It should be understood that the insert 90 can be molded in a variety of shapes and sizes.

Figure 6:
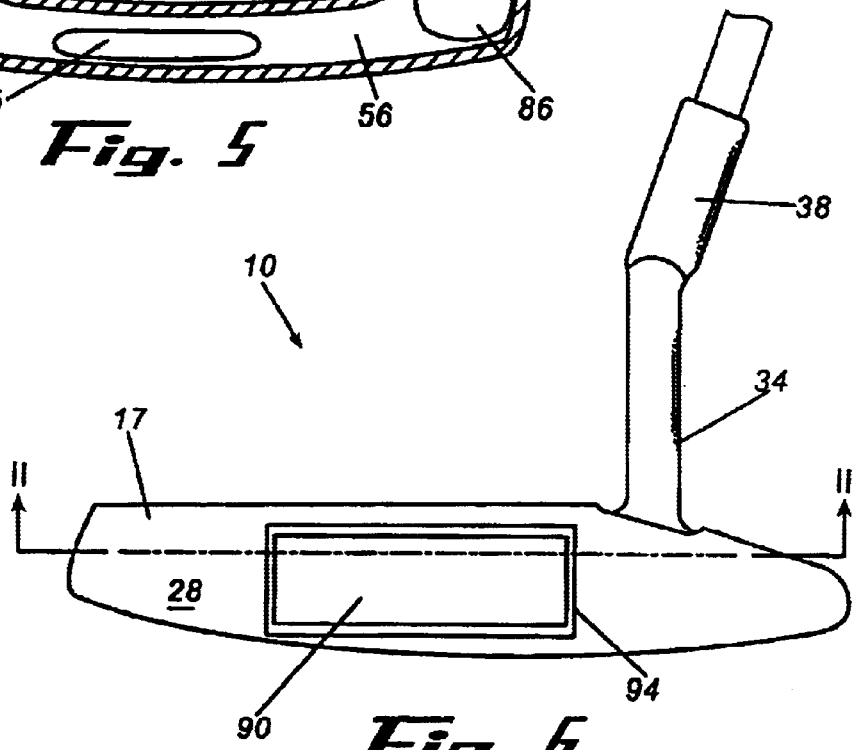
FIG. 6 is a front elevation view of another embodiment of the present invention.

The putter head 10 can be filled with the lightweight polymer as described above. The walls of the rectangular ridge 88 are substantially hollow such that they are also filled with polymer. After the polymer has hardened, the rectangular ridge 88 is machined off, leaving a smooth flat striking surface 28 and a centered, fixed and suspended insert 90. As shown in FIG. 6, the insert 90 is suspended in the putter head 10 by the hardened polymer 94. The periphery of the insert 90 is surrounded by the hardened polymer 94.

Figure 10:
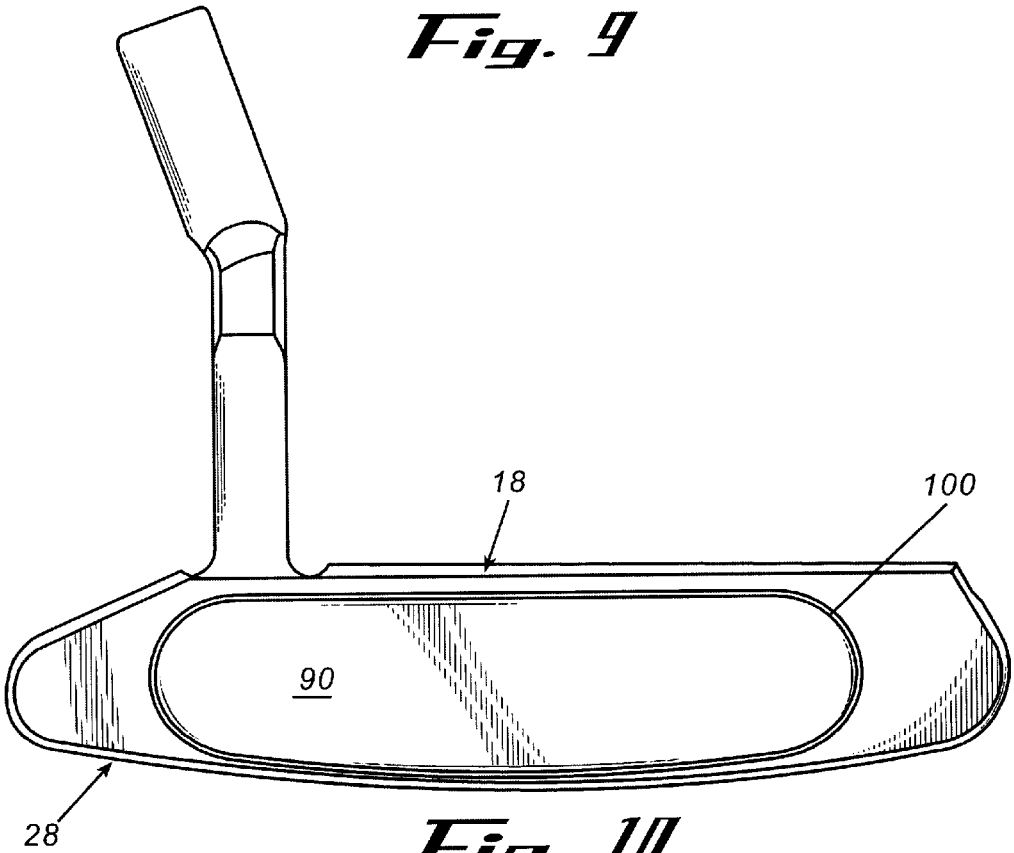
FIG. 10 is a front elevation view of the putter head of the present invention including an insert.
Figure 11:
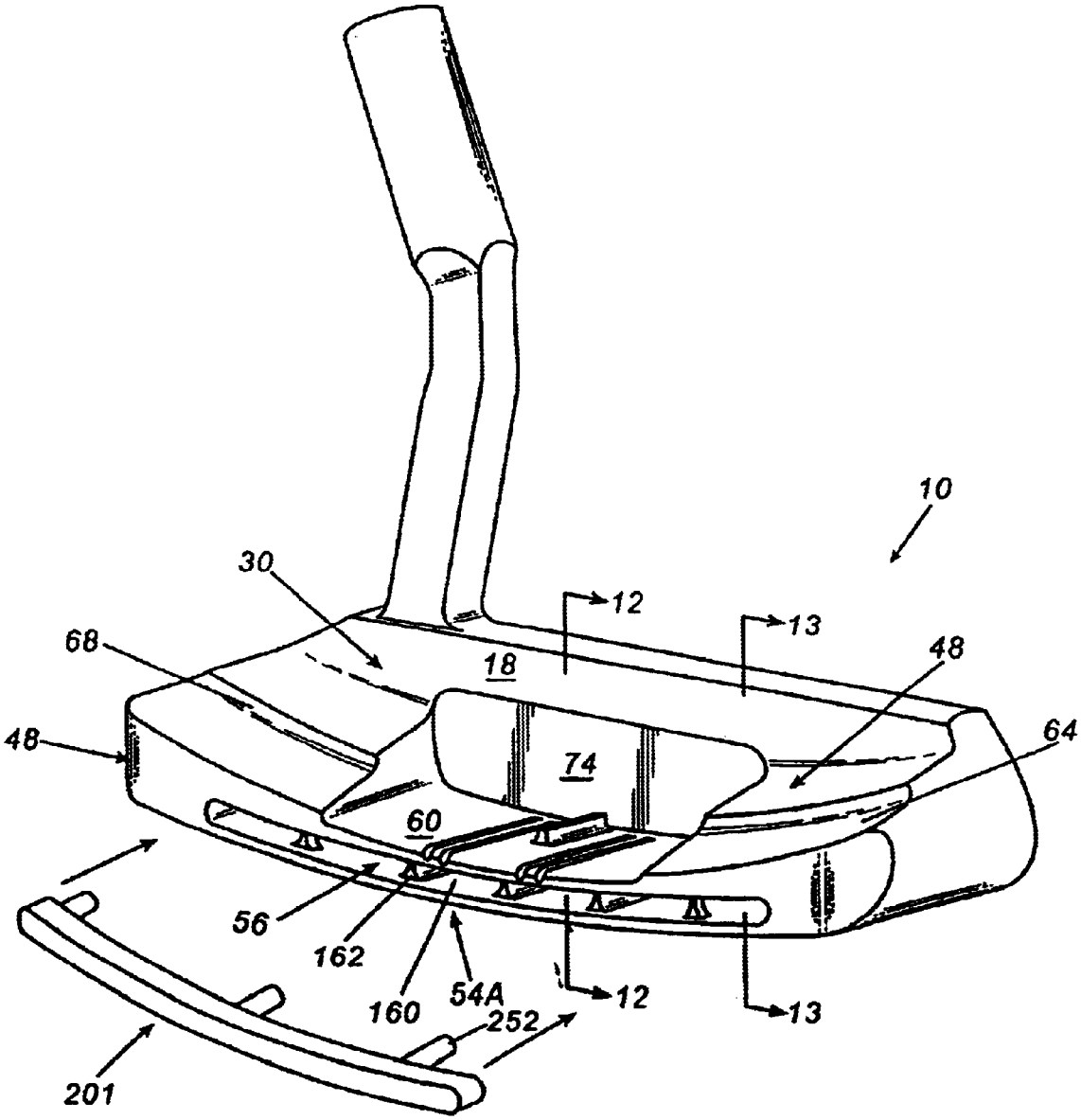
FIG. 11 is a perspective rear view of an embodiment of the present invention.
Figure 12:
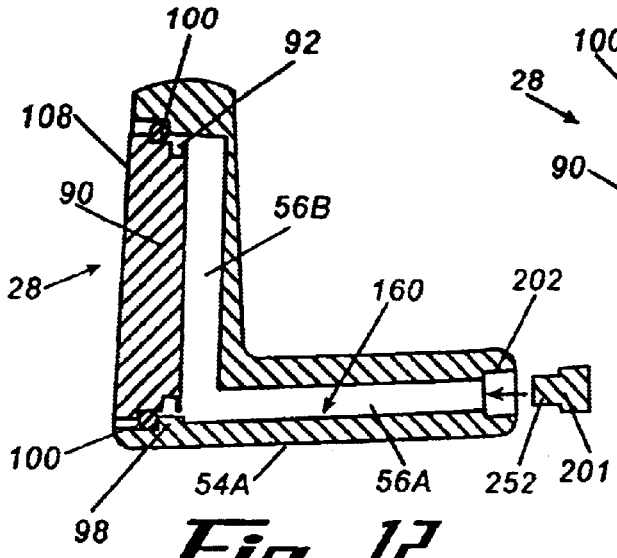
FIG. 12 is a cross-sectional side view along line 12—12 of FIG. 11.

Referring to FIGS. 11 and 12, the present invention is shown including an "L-shaped" cavity 56 (FIG. 3). FIG. 12 is a cross-sectional view along lines 12—12 of FIG. 11. Horizontal cavity portion 56A extends between the sole 54A of the putter head 10 and the flange 48 beneath recess 60. Cavity portion 56A joins vertical cavity portion 56B to form "L-shaped" cavity 56. Vertical cavity portion 56B extends vertically between the shallow recess 74 and rear surface 30 of the blade 18 and the striking face 28 of the putter and may in some embodiments (FIG. 10) extend between the toe 64 and heel 68 and the striking face 28. As shown, cavity portions 56A and 56B are preferably continuous and comprise cavity 56. However, in alternative embodiments horizontal cavity portion 56A and vertical cavity portion 56B may be formed as distinct, unconnected cavities.

Figure 9:
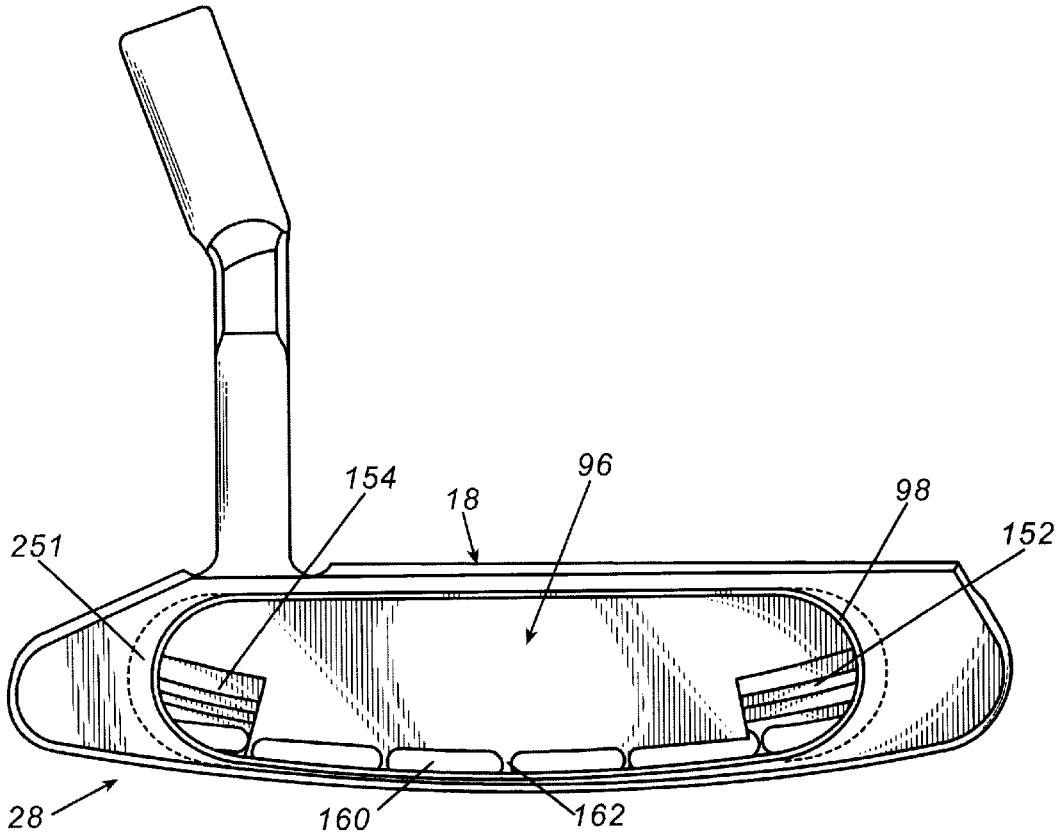
FIG. 9 is a front elevation view of the putter head of the present invention with an insert removed from the insert opening in the striking face.
Figure 14:
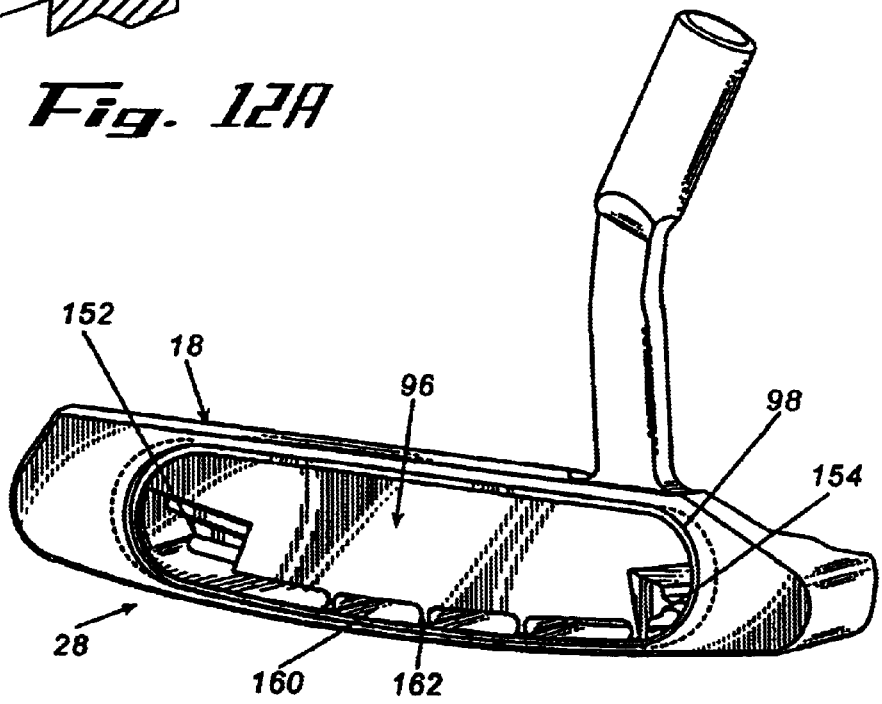
FIG. 14 is a front perspective view of an embodiment of the present invention.

Referring to FIGS. 9, 11 and 14, through an insert opening 96 in striking face 28, a core can be removed or a cutting tool can reach the internal cavity space 56. From face opening 96, the vertical portion 56B of the internal cavity 56 is formed. The vertical cavity 56B may extend beyond the diameter of opening 96 to form undercut 251 which provides additional locking of the polymer 94 to the head 10, as well as providing additional metal removal to reduce weight.

Vertical portion 56B includes a height measured in a direction between the bottom sole 44 and the blade top surface 22, a length measured in a direction between the heel end and the toe end of the putter head 10, and a width measured in a direction between the striking face 28 and the rear blade surface 30 (which may include shallow recess 74 in some embodiments). In an embodiment of the present invention, the length is greater than the height, and the height is greater than the width.

The horizontal portion 56A of the cavity can be formed through the rear slot opening 58 in the flange 48. Referring to FIGS. 9, 11, 12, and 14, the horizontal cavity portion 56A may also be formed by a plurality of horizontal cavities 160. Pillars or supports 162 between each of cavities 160 provide internal support within the flange 48 preventing deformation during manufacturing and ensuring an evenly spaced rear slot opening 58. Referring to FIGS. 11 and 12 horizontal cavity portion 56A is depicted integrated in flange 48 between sole 54A and heel portion 68 and toe portion 64 of the flange 48. Horizontal cavity 56A also extends beneath the bottom surface of recess 60.

Figure 13:
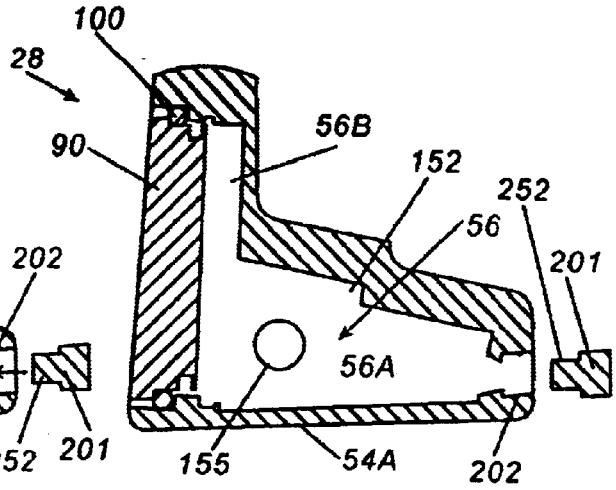
FIG. 13 is a cross-sectional side view of the putter head of the present invention along line 13—13 of FIG. 11.

Referring to FIG. 13, and with continuing reference to FIGS. 9, 11, and 14, a cross-sectional view of toe 64 and internal cavity 56 is shown. Within flange 48 of toe 64, toe cavity portion 152 connects and cooperates with cavity portions 56A and 56B to form cavity 56. Similarly, as shown in FIGS. 9 and 14, a heel cavity portion 154 is provided in the present invention. Toe and heel cavity portions 152 and 154, respectively, increase the cavity 56 space inside the "stepped" toe 64 and heel 68 sections of the flange 48. Accordingly, toe cavity portion 152 and heel cavity portion 154 increase the amount of metal replaced by polymer, allowing a larger putter head 10 to be constructed.

In an embodiment of the present invention, the desired polymer 94 may be added in horizontal cavity portion 56A through opening 58 (FIG. 11) until the polymer fills cavity 56 up to counter bore 202 (FIG. 13), including vertical cavity portion 56B. Alternatively, the polymer may be added through insert hole 96 (FIGS. 19 and 14) prior to addition of the insert 90.

Referring to FIG. 11, in a further embodiment, rear slot plug 201 is inserted into rear slot opening 58, filling counter bore 202 (FIG. 13). Tangs 252 extending from the slot plug 201 engage the polymer in cavity 56, fixing the plug 201 and sealing the rear slot opening 58. The rear slot plug 201 may be constructed to extend beyond the rear slot opening 58 when inserted and fixed such that a portion of the plug 201 extending out of the slot opening 58 may be removed to become flush with the opening 58. The rear slot plug may be made from a material such as polypropylene that can be removed with a cloth grinding belt so as to avoid scarring the finish of the putter head 10. This arrangement has particular applicability when the putter head 10 is of machined and plated steel construction. In other embodiments, the rear slot plug 201 may be made close fitting and constructed from material such as aluminum.

Referring to FIG. 14, in a further embodiment of the present invention, heel cavity 154 and toe cavity 152 include weights, such as weight 155 (FIG. 13), of a material higher in density than the material comprising polymer 94, and are suspended within polymer 94 when cavity 56 is filled with lightweight polymer 94. Preferably, such weights do not touch the metal portions of the putter body, but are completely suspended in lightweight polymer 94 anywhere within the respective internal portions of cavity 56, and preferably in the heel 68 and toe 64 of the putter head 10. In order to achieve suspension of the weights with no metal to metal contact, the weights may be dipped in polymer prior to insertion, as previously described.

Where a sole plate 54 (FIG. 3) is attached as sole 54A (FIGS. 11, 12 and 13), rather than the sole 54A being of a single continuous material as the flange 48 (as in other embodiments), the polymer 94 may be added through the bottom of the putter, prior to attachment of the sole plate 54. In such embodiment, the sole plate 54 is a separate piece, rather than constructed of a single continuous material with the flange 48, that is attached to the flange 48 after casting or machining of the flange 48 including internal cavity 56. Further, in such embodiments including a sole plate 54, casting, molding, or machining of the internal cavity portions may be made through the open sole portion of the putter head prior to attachment of the sole plate 54.

Figure 16:
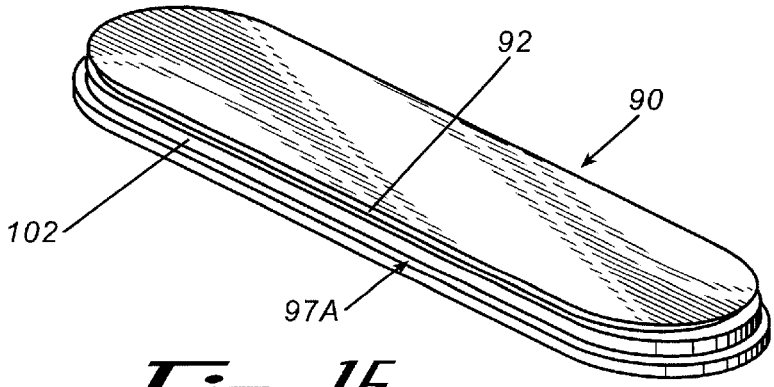
FIG. 16 is a back perspective view of an insert in an embodiment of the present invention.

As shown in FIGS. 10, 12 and 16 the striking face 28 may optionally include insert 90. The insert can be shaped to desired shapes and sizes. The insert is preferably a metallic insert of the same material as the putter body. However, the insert may comprise materials of varying materials and densities in order to achieve desired results.

Referring to FIGS. 9 and 14 an insert opening 96 is provided for receiving insert 90. The insert opening 96 includes insert groove extension 98 and groove extension step 97B, to control entry of the insert 90 into vertical cavity portion 56B.

As shown in FIGS. 10, 12, 12A and 13, O-ring 100 surrounds the insert 90 to control the positioning within the insert face 28 providing a constant dimension between insert step 102 and insert groove extension 98.

The insert 90 secures into the striking face 28 (FIG. 1) and blade 18 of the putter head 10. The insert 90 extends into the vertical cavity portion 56B where it is secured by the addition of polymer 94 to hold insert 90 in place.

Referring to FIGS. 12, 12A, 13, and 16, O-ring 100 surrounds the insert 90 to abut grooved extension 98 (FIGS. 12A and 14) and groove extension step 97B (FIG. 12A) prior to addition of polymer in vertical cavity portion 56B. The insert 90 also has an undercut, or insert groove 92, on its side opposing the striking surface 28. Insert groove 92, surrounding the back edge of insert 90, permits insert 90 to be held in place when polymer 94 entering vertical cavity portion 56B surrounds the insert groove 92 and hardens. The insert groove 92 may be provided with relief intervals in the periphery to allow the polymer 94 easier access to the groove 92.

Figure 12A:
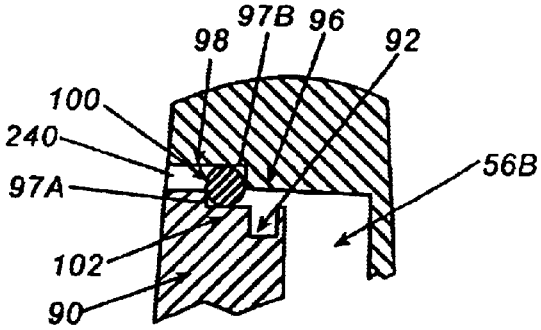
FIG. 12A is a detail view of FIG. 12.

Referring to FIGS. 10 and 12A, and further reference to FIGS. 9, 14 and 16, insert 90 is approximately 0.02 to 0.1 inches smaller in its outside diameter than the opening 96 in the putter head provided for insert 90. An additional diameter is provided in the insert piece 90 smaller than the outside diameter and recessed behind the outside diameter approximately 0.02 to 0.15 inches to form an O-ring steps 102 and 97A in the diameter of the insert 90. O-ring 100 is provided to fit in the corner formed by steps 102 and 97A, the O-ring 100 communicating with a matching step and corner, or insert groove extension 98 and groove extension step 97B, provided in the putter body. The O-ring 100 forms a new outside diameter of the insert 90 which is larger than the inside diameter of the insert opening 96. The O-ring 100 is slightly compressed for the insert 90 to enter groove extension 98, centering the insert in the opening 96 while the depth of insert 90's insertion into opening 96 is determined by contact of step 97B created between 98 and 96, O-ring 100, and step 97A created between 102 and the outside diameter of insert 90. The insert 90 is thus prevented from passing through the insert opening 96 and is held in a centered position by the O-ring 100 communicating between insert O-ring step 102 and grove extension 98 and groove extension vertical step portion 97B.

The relative positions of the opposing steps 97A and 97B in the insert 90 and putter body, respectively, are further located to position the striking face of the insert 90 a small distance beyond the striking surface of the putter head when the O-ring 100 is not compressed and at a neutral unloaded condition.

Prior to assembly, the striking surface 28 of the putter head is machined flat as well as the insert 90 in separate operations. During assembly, the putter head 10 along with the insert 90 suspended by the O-ring 100, is clamped striking face 28 down on a flat plate compressing the O-ring 100 and aligning the surfaces of the insert 90 and putter head striking face 28 into a single plane. As the putter head 10 is back filled with polymer 94 from the rear slot opening 58 (FIG. 11) in the flange 48, the insert 90 is fixed in place and held suspended by both the O-ring 100 and the polymer engaging groove 92. The O-ring also acts as a seal and prevents the polymer 94 from flowing onto the face down surface of the striking face 28, or filling the outward facing separation 240 formed between insert groove extension 98 and outside diameter of insert 90. This embodiment allows any number of different insert materials to be used as well as plated inserts in which no machining or other flattening of the overall striking surface is needed after assembly.

A further advantage of the suspended insert 90 is that it acts as a suspended weight in the polymer shell and dampens vibration much more efficiently than if connected by conventional means. In additional embodiments the polymer may consist of two different materials each being poured at different intervals and each having different properties. An example would be first polymer pour into vertical cavity 56A of a material with properties more suited to attaching the suspended insert in place, and a second polymer pour filling the remaining horizontal cavity 56B of a material more suited to attaching the rear slot plug 201.

With continuing reference to FIG. 10, and further reference to FIG. 9 in an embodiment of the present invention insert 90 comprises at least fifty percent (50%) of the total striking surface of the striking face 28 of the putter head 10. Insert 90 is formed to be centered and suspended in the insert recess opening 96, and is held in place by polymer 94 introduced into and filling the internal cavity 56 of the putter head 10. In an embodiment of the present invention the insert 90 does not touch directly the material of the putter body itself, but is suspended by the polymer 94 filling the internal cavity 56, including vertical portion 56B.

When insert 90 is used in an embodiment of the present invention, sole 54A is preferably cast, machined or molded as a single material with flange 48 because in such embodiment the insert opening 96 (FIG. 9) is sufficiently large to permit coring or machining of internal cavity portions 56A and 56B (FIG. 12).

In an embodiment of the present invention that includes insert 90, the polymer 94 is added through opening 58 or open insert recess 96 and fills all of horizontal cavity portion 56A, vertical cavity portion 56B, heel cavity portion 154 and toe cavity portion 152. As all of the cavity portions cooperate as cavity 56, the polymer 94 fills the internal portions of the flange 48 and the vertical volume behind insert 90 and between the rear surface 74 of blade 18.

In embodiments where the striking surface 28 does not include insert 90, and is solid, the polymer 94 similarly fills cavity 56 including the respective cavity portions to create a putter head with a dampening effect that reduces the "pinging" sound when striking a golf ball.

A study was made of a conventional putter design of conventional size as compared to a putter of similar size but made according to the present invention. The conventional putter used was a Ping Anser, which is a heel-toe weighted, cavity-backed flanged blade putter. The Ping Anser had a moment of inertia of 3357 gram centimeter squared, while a putter of the present invention (containing a hollow cavity filled with a hardened polymer) had a moment of inertia of 3869 gram centimeter squared. Thus, in this case the inertia was increased by approximately 15%. This increase in inertia was accomplished without the accompanying ringing or hollow sound usually associated with a thin shelled heel and toe weighted putter head. Higher increases in inertia can be detained over conventional sized putters as the size of the putter head of the present invention is expanded. The increase in moment of inertia prevents the putter from twisting if the ball is struck slightly away from the center of mass of the putter head, effectively increasing the size of the sweet spot.

A putter made in accordance with the present invention may have a weight range of from 280 grams to 400 grams. It may range in blade length from 4.5 to 6.25 inches and in width from 1 inch to 2.75 inches. Blade height may range from 0.9 to 1.35 inches.

While the invention has been described with reference to structures and methods disclosed, it is not confined to the details herein but is intended to cover such modifications or changes as may fall within the scope of the following claims.

What is claimed is:

1. A golf putter head comprising:

a) a blade with a forwardly facing striking face, wherein the blade includes a rear blade surface and a blade top surface, wherein the blade top surface extends from the striking face to the rear blade surface;

b) a flange extending substantially perpendicular from the blade, wherein the flange includes a rear flange surface opposite the striking face;

c) a horizontal cavity extending from the rear flange surface towards the striking face, between a bottom sole of the head and an upper surface of the flange; and d) a vertical cavity between the striking face and the rear blade surface, wherein the vertical cavity includes a height in a direction from the bottom sole to the blade top surface, a length in a direction from a toe end of the putter head to a heel end of the putter head, and a width in a direction from the striking face to the rear blade surface, and wherein the length is greater than height and the height is greater than the width, wherein the vertical cavity and horizontal cavity are interconnected.

2. The golf putter head of claim 1 wherein the vertical cavity and horizontal cavity form an internal "L" shaped cavity.

3. The golf putter head of claim 2 wherein the rear surface of the blade includes a vertical face of a sighting recess.

4. The golf putter head of claim 2 wherein the blade comprises a blade material and the "L" shaped cavity includes at least one polymer having a density less than the blade material.

5. The golf putter head of claim 4 wherein the striking face includes an insert suspended by the at least one polymer.

6. The golf putter head of claim 5 wherein the horizontal cavity includes a rear flange opening closed with a rear slot plug.

7. The golf putter head of claim 4 wherein the rear flange surface includes an opening into the horizontal cavity of the "L" shaped cavity.

8. The golf putter head of claim 7 wherein the horizontal cavity of the "L" shaped cavity contains vertical supports between a bottom surface of the horizontal cavity and a top surface of the horizontal cavity.

9. The golf putter head of claim 7 wherein the rear flange opening is closed with a rear slot plug.

10. The golf putter head of claim 5 further comprising:

a) an opening in the striking face for receiving the insert, the opening having a first diameter and a second smaller diameter defining a step with the first diameter, wherein a side wall of the first diameter and the step define an insert groove extension, and wherein the first diameter defines an externally exposed peripheral edge to the opening in the striking face;

b) an O-ring surrounding the insert, wherein the O-ring abuts the insert groove extension centering the insert in the opening of the strike face, and controlling the depth into which the insert enters the vertical cavity.

11. The golf putter head of claim 5 further comprising:

a) an insert groove extension in the striking face; and b) an O-ring surrounding the insert, wherein the O-ring abuts the insert groove extension to control the depth into which the insert enters the vertical cavity.

12. The golf putter head of claim 11 wherein the rear surface of the blade includes a vertical face of a sighting recess.

13. The golf putter head of claim 1 wherein the horizontal cavity and the vertical cavity each include at least one polymer having a density less than the blade material.

14. The golf putter head of claim 13 wherein the striking face includes an insert suspended in the at least one polymer of the vertical cavity.

15. The golf putter head of claim 14 wherein the horizontal cavity and the vertical cavity are interconnected to form an "L" shaped cavity and the rear surface of the blade includes a vertical face of a sighting recess.

16. The golf putter head of claim 13 wherein the horizontal cavity includes a horizontal cavity opening in a rear surface of the flange opposite the striking face.

17. The golf putter head of claim 16 wherein the horizontal cavity opening includes a rear slot plug.

18. The golf putter head of claim 14 wherein the horizontal cavity includes a horizontal cavity opening with a rear slot plug in a rear surface of the flange opposite the striking face.

19. The golf putter head of claim 13 further comprising at least one weight suspended in the at least one polymer.

20. The golf putter head of claim 19 further comprising at least one weight suspended in the toe end of the putter head and at least one weight suspended in the heel end of the putter head.

21. A golf putter head comprising:

a) a striking face;

b) a sighting recess;

c) a horizontal cavity extending between a rear flange surface and the striking face beneath the sighting recess; and d) a vertical cavity connecting to the horizontal cavity, the vertical cavity extending between the striking face and sighting recess, wherein the vertical cavity includes a height in a direction from a bottom sole to a blade top surface and a width in a direction from the striking face to a rear blade surface, and wherein the height is greater than the width.

22. The golf ball putter head of claim 21 wherein the striking face comprises a first material and each of the horizontal cavity and the vertical cavity include at least one polymer of a second material with a density less than the first material.

23. The golf putter head of claim 22 wherein the striking face includes an insert suspended by the at least one polymer in the vertical cavity.

24. The golf putter head of claim 23 further comprising:

a) an insert groove in the striking face; and b) an O-ring surrounding the insert, wherein the O-ring abuts the insert groove to control the depth into which the insert enters the vertical cavity.

25. The golf putter head of claim 22 wherein the vertical cavity connects to the horizontal cavity to form an L-shaped cavity.

26. The golf putter head of claim 25 wherein the L-shaped cavity includes one or more weights suspended in the at least one polymer.

27. The golf putter head of claim 21 wherein the horizontal cavity includes at least one polymer with a density less than a material forming the putter head surface.

28. The golf putter head of claim 27 wherein the horizontal cavity is closed with a rear slot plug.

29. The golf putter head of claim 21 wherein the vertical cavity includes at least one polymer with a density less than a material forming the putter head surface.

* * * * *